United States Patent [19]

Dungan

[11] 4,295,547

[45] Oct. 20, 1981

[54] BRAKE ASSEMBLY FOR SMALL VEHICLES

[76] Inventor: D. Patrick Dungan, 901 Sherman St., #1322, Denver, Colo. 80203

[21] Appl. No.: 135,869

[22] Filed: Mar. 31, 1980

[51] Int. Cl.[3] ..... B60T 1/04; B60T 1/06

[52] U.S. Cl. ..... 188/2 R; 188/2 D; 188/71.1; 188/72.4; 280/11.2

[58] Field of Search ..... 188/2 R, 24, 25, 26, 188/27, 18 A, 2 D, 21, 71.1, 71.3, 71.4, 72.4, 84, 366, 369, 370; 280/11.2, 87.04 R, 87.04 A

[56] References Cited

U.S. PATENT DOCUMENTS

| | | | |
|---|---|---|---|
| 1,628,559 | 5/1927 | Showers | 188/26 X |
| 2,359,516 | 10/1944 | Frank | 188/72.4 X |
| 2,366,093 | 12/1944 | Forbes | 188/366 X |
| 4,032,200 | 6/1977 | Farr | 188/344 X |
| 4,076,266 | 2/1978 | Krausz | 280/11.2 X |
| 4,175,648 | 11/1979 | Sule | 188/344 |

FOREIGN PATENT DOCUMENTS

| | | | |
|---|---|---|---|
| 800196 | 8/1958 | United Kingdom | 188/24 |
| 1088200 | 10/1967 | United Kingdom | 188/72.4 |

*Primary Examiner*—George E. A. Halvosa
*Attorney, Agent, or Firm*—Kyle W. Rost

[57] ABSTRACT

Skate boards, roller skates, and like small vehicles are equipped with a mechanical or hydraulic brake that acts against one side wall of vehicle wheel, and a cooperating stationary assist unit at the opposite wheel face is contacted by the opposite face if the wheel deforms under braking pressure. The brake assembly in hydraulic mode includes a reservoir joined to two drum members that fit between the two wheels and their truck on a single axle, and the drums each house an annular axially moveable friction member that is applied against the inside face of the wheel by hydraulic force. The assist unit is carried on the axle opposite the outside wheel face and substantially conforms in contour to that face. Alternate friction members may be cylinders that are applied to the wheel face offset from the axle, and alternate reservoirs may be attached to the vehicle body or to a remote activating hand lever.

18 Claims, 9 Drawing Figures

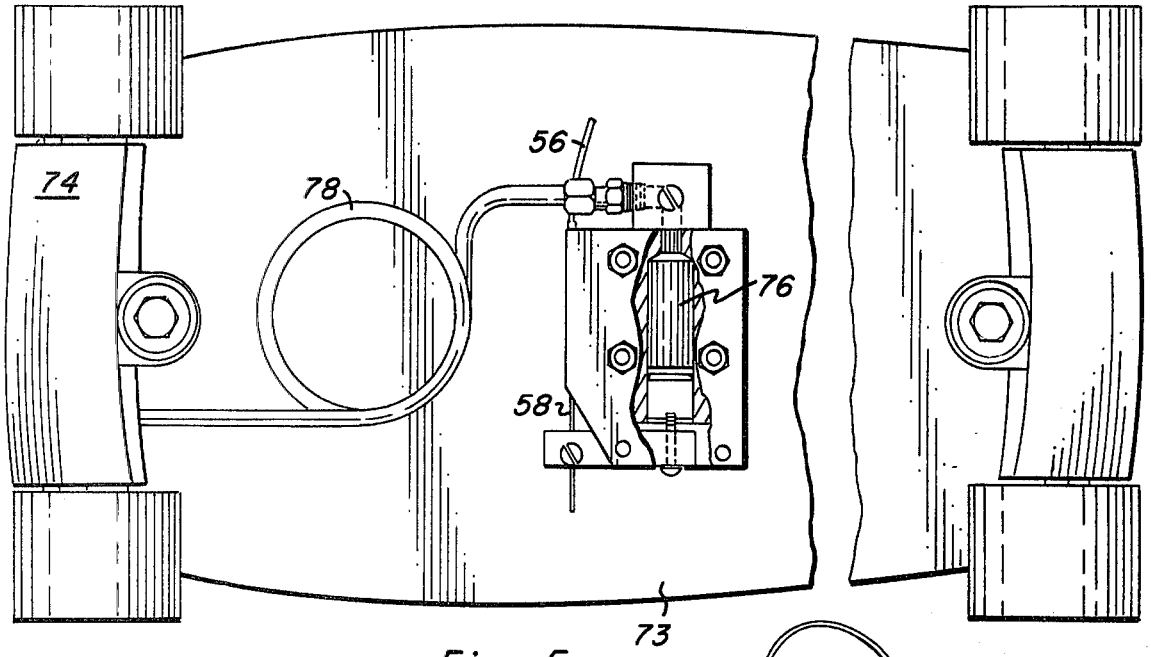
Fig.-5
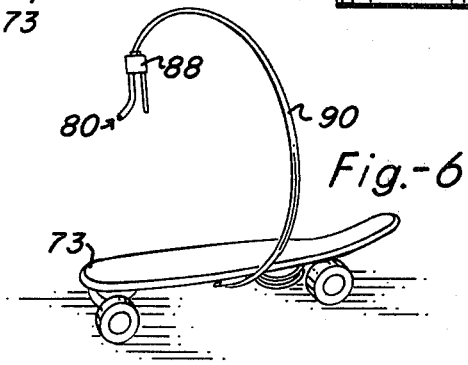
Fig.-6
Fig.-7
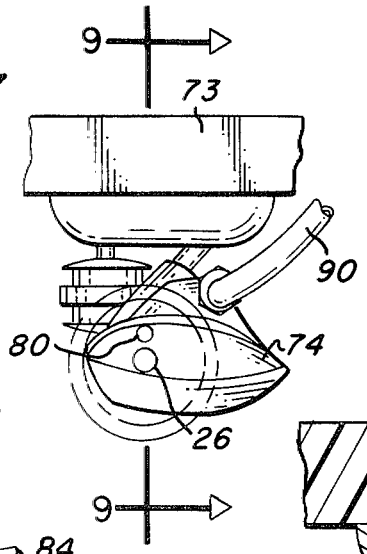
Fig.-8
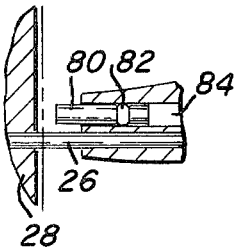
Fig.-9
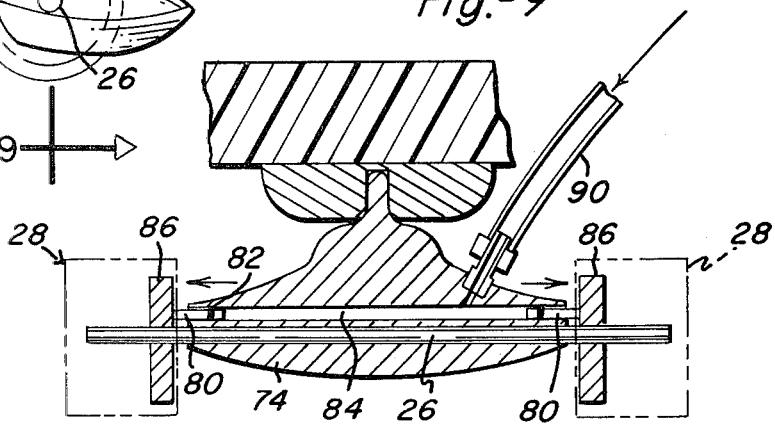

BRAKE ASSEMBLY FOR SMALL VEHICLES

BACKGROUND OF THE INVENTION

1. Field of the Invention

The invention relates to land vehicles and also to brakes. The invention is specifically related to mechanically or hydraulically actuated brakes applicable to skate boards, roller skates and the like wherein a brake drum is not employed.

2. Description of the Prior Art

Skate boards, roller skates, and other small wheel mounted devices have often not been supplied with brakes because the small wheel size prohibited the use of drum or disc brakes as have been developed for use on larger and heavier vehicles such as automobiles and bicycles. This state of affairs has presented a problem to beginners not yet proficient in the use of such vehicles, and in some cases experts have found that the scope of possible activity on such recreational devices was limited by the lack of a selective braking control.

At least in the skate board art there are known to be braking assemblies now available, some of which operate as automatic safety brakes that are applied when the rider dismounts from the board, intentionally or accidentially. Others are selectively applied by the rider, as by foot pressure on a lever or arm. All of the known devices operate by means of a friction applying member or pad that contacts the running surface of the wheels. U.S. Pat. Nos. 4,003,582 to Maurer; 3,385,608 to Waddell; and 3,288,251 to Sakwa teach brakes of the types described. None of the noted devices are believed to be commercially available, but experiments with brakes applying friction to the periphery of the wheels have shown that braking is relatively weak, which may be because the contact area is quite small or because the running surface of the wheel can become coated with dirt, grease, or water, depending upon the condition of the surface where the vehicle is operated. The strength and reliability of braking are therefore addressed by the present invention, as will be better understood from the following description.

SUMMARY OF THE INVENTION

A brake for vehicles having wheels riding on axles, wherein space limitations are prohibitive of traditional brake drum use, employs a friction member mounted facing a radially extending side wall of the wheel and having means associated therewith for applying the friction member directly against the wheel side wall. When the wheel is formed from a deformable, resilient material such that the axial pressure applied by the friction member is capable of axially deforming the wheel temporarily, braking is improved by an assist unit generally paralleling the opposite side wall of the wheel and limiting the available degree of wheel deformation as well as providing a cooperative friction surface to act against the opposite side wall for further braking action. The friction member is preferred to be annular and concentrically aligned with the wheel axle. A hydraulic activating system is preferred, wherein a reservoir housing is integrally joined to drum housings that fit between each wheel and its truck to attach the reservoir housing to the axle, thereby adapting wheel trucks not specifically engineered for use with a brake to accept the brake assembly. In other applications, a hydraulic reservoir may be carried attached to the vehicle at another point or attached to a hand activating lever remote from the vehicle. In the latter two cases, the reservoir is connected to the wheel truck by a conduit.

An alternate structure for the friction member is a cylinder that strikes the inside face of the wheel at an offset location from the axle. The wheel face may have an attached or inset wear resistant portion that receives the contact from the friction member to prevent the otherwise easily eroded inside wheel face from being worn away.

The main object of the invention is to create a brake for small vehicles such as skate boards and roller skates, wherein the brake applies its frictional force against the side of the wheel or against the side of a contact member joined to rotate with the wheel.

A further object is to provide a brake that takes advantage of the resilient nature of typical skate board and roller skate wheels to apply a fixed brake assisting member spaced from the wheel face opposite from the brake friction member, whereby the deformation of the wheel under pressure from the friction member is limited by eventual contact between the deformed wheel portion and the assisting member, and the assisting member then acts as a cooperative braking device to further retard wheel rotation.

Another object is to create a brake for gravity or inertia driven vehicles requiring rider balancing, wherein the rider controls the brake from a remote activation device such as a hand engagable squeeze lever connected to the wheel truck or vehicle by a cable or conduit, eliminating the need to operate the brake by foot movement.

BRIEF DESCRIPTION OF THE DRAWINGS

FIG. 5 is a bottom view of a skate board with a modified version of the brake attached.

FIG. 6 is a perspective view of a skate board having the brake and hand control attached.

FIG. 7 is a fragmentary side view of a wheel truck modified to accept the brake.

FIG. 8 is an enlarged fragmentary view of the brake friction member of FIG. 9 and its mounting.

FIG. 9 is a cross-sectional view taken along the plane of line 9—9 of FIG. 7.

DESCRIPTION OF THE PREFERRED EMBODIMENT

Figure 1:
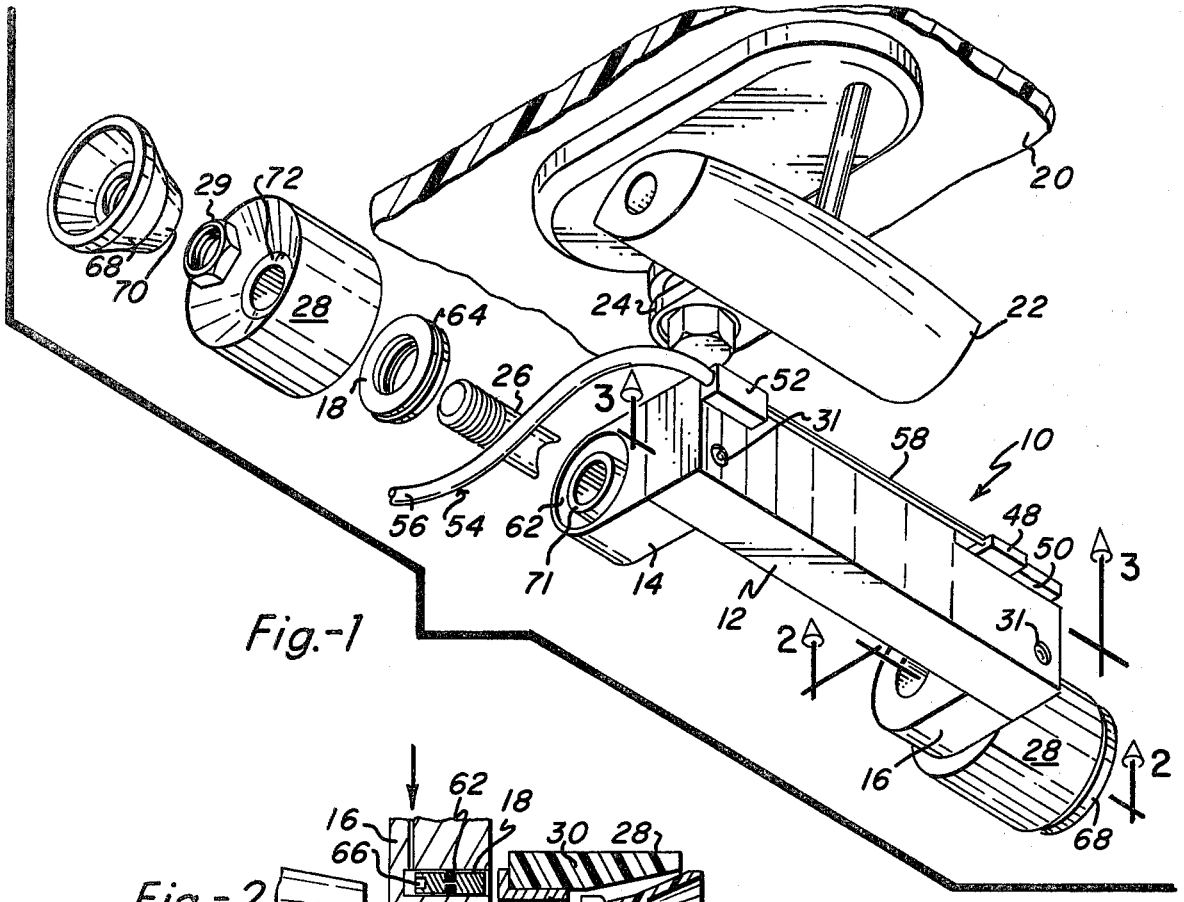
FIG. 1 is an exploded view of the brake and an associated wheel truck and vehicle.

The brake may best be understood by reference to FIGS. 1–4 wherein the brake assembly 10 is shown in an embodiment suitable for hydraulic activation. A reservoir housing 12 carries a pair of spaced apart drum members 14, 16, and each of these carries a movable friction member 18. This assembly 10 is then adaptable to be mounted on a skate board or roller skate of the types presently used, with each drum 14, 16 mounted between a wheel and its truck.

The typical vehicle with which the brake assembly 10 might be employed will have a platform 20, which may be a shoe sole or skate board body as just two examples. This platform carries a wheel truck 22, which may be connected to the platform by a suspension system such as rubber damped mounts 24 or the truck can be rigidly mounted to the platform without adverse effect on the braking assembly. An axle 26 is carried by the truck and extends from both sides thereof, or separate axles may extend from each side of the truck, in either case providing a mounting support for a wheel 28 on each axle or axle end exposed from the truck. Each wheel 28 telescopes over its axle and is held in place between the truck and the axle end by a locking device such as a nut 29. Each wheel includes its own precision bearing that is in intimate contact with the axle and supports the outer portion 30 of the wheel thereon. This outer portion is composed of a synthetic plastic or elastomer such as polyurethane that is resilient and has good vibration damping characteristics.

Brake assembly 10 is applied to a conventional wheel truck by mounting the drum members 14, 16 over opposite ends of axle 26, which may be accomplished by separating one drum member from the reservoir, permitting the drums to be sufficiently separated to pass over the opposite axle ends, after which the drum is reattached by means of screws or other suitable fasteners 31. The wheels 28 may then be placed in telescoped position over the axle ends and held in place by a locking device 29. When a preexisting wheel truck is adapted for use with the brake assembly, the original axle may be replaced with a slightly longer axle so that sufficient length is available for mounting the wheels. The axle may have a key 32, FIG. 2, adjacent to the truck 24 for mating with a keyway 34 in at least one drum member to hold the brake assembly in a fixed rotational position.

Reservoir housing 12 contains a cavity 36 for hydraulic fluid of any suitable type. A piston 38 is movable within the cavity and may be provided with a seal 40 such as an O-ring. A spring 42 biases the piston in one direction. The activating means for the brake assembly may be a slide 44 received in a bore 46 near one end of the reservoir and having an arm 48 extending through a slot 50 parallel to the bore. A mounting block 52 is near the opposite end of the reservoir and approximately aligned with the plane of the slot. A cable and sheath assembly 54 may be associated with the mounting block with the sheath 56 anchored in the block and the cable 58 extending through the block and attached to the slide arm 48. A pulling force applied to the cable is thus transmitted to the slide 44, drawing the slide into the bore 46 and forcing the piston against spring 42 to apply pressure to fluid in the cavity 36.

Figure 2:
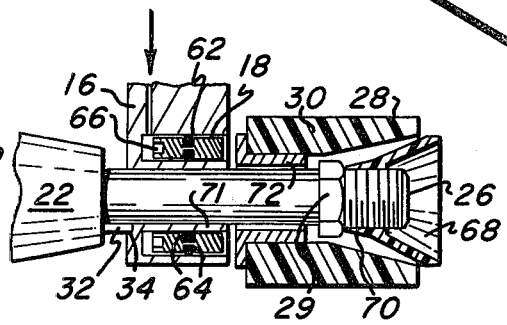
FIG. 2 is a cross-sectional view taken along the plane of line 2—2 of FIG. 1.
Figure 3:
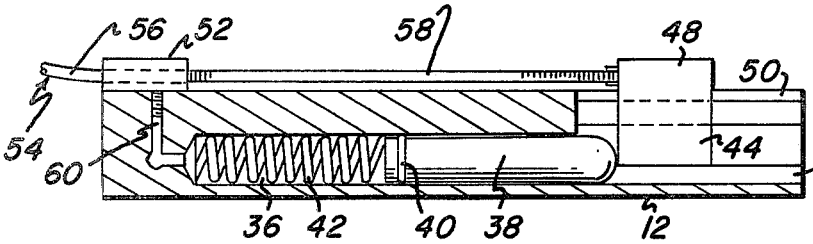
FIG. 3 is a cross-sectional view taken along the plane of line 3—3 of FIG. 1.
Figure 4:
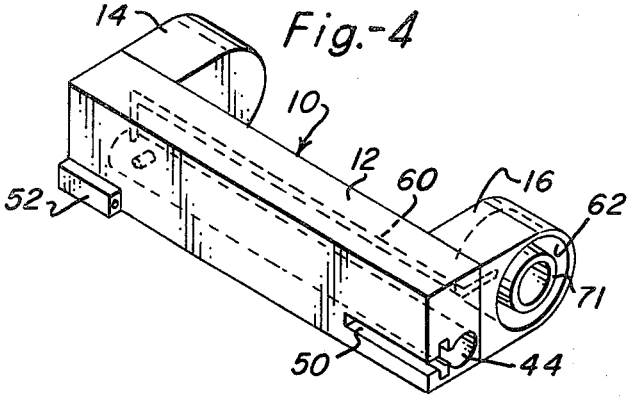
FIG. 4 is a perspective view of the brake with internal structure shown in phantom.

Each drum member 14, 16 has a fluid passageway 60 leading from the cavity 36 to a local cavity 62 in each drum. As best shown in FIGS. 1 and 2, the preferred local cavity 62 is an annular recess in the laterally facing side of each drum in closest proximity to the wheel 28. The friction member 18 associated with each recess has a complimentary shape to fit closely within the recess. Sealing means such as O ring seals 64 are carried in either the recess walls or the friction member walls to contain hydraulic fluid. The friction member may have a special contour such as groove 66 on its rear end to aid the hydraulic fluid in applying a uniform pressure when the brake is applied.

Braking action is achieved when the friction member 18 is forced by the hydraulic pressure in recess 62 to move outwardly from drum 14,16 and against the inside wall of the wheel 28. The friction member or brake pad 18 may be quite large with respect to the available surface area on the inside of the wheel and can thereby exert a substantial braking force. The resilient material of the wheel is capable of substantial deformation in the axially outward direction under pressure from the brake pad, and this deformation capability may be employed to advantage in causing more positive braking action. In FIGS. 1 and 2, an axle mounted brake-assisting unit 68 limits the available amount of outward deformation of the wheel. The inward facing wall of unit 68 conforms in contour approximately to the outward face of the wheel and is separated from the outward wheel face by a small distance such as one-eighth inch or less. The exact clearance is determined by the length of the threaded stem 70 of the assist unit, and may also be determined by the available length of thread on the axle. The wheel nut 29, a pair of lock nuts or washers may be appropriately positioned as shim means to locate the braking-assist unit at the desired clearance, or the stem 70 may be ground to the desired length. Rotation of the assist unit is prevented by provision for axle threads in the proper direction such that the wheel tends to tighten the assist unit on the thread when braking force is applied between the two. Alternatively, and especially where braking may be required in either forward or reverse directions, the assist unit may be keyed to the axle and held against removal by a locking device such as nut 29, with the nut and assist unit being reversed in position on the axle in FIG. 2. Additionally, a nut 29 or shim of other description, including an axial extension of the inner drum wall 71, may space the wheel and its bearing or bushing 72, FIG. 2, from the drum to prevent unwanted friction between the wheel and brake pad.

Variations in the design of brake 10 are shown in FIGS. 5–9, where the brake is shown attached to a skateboard 73. In FIG. 5, at least one truck 74 is specially designed to contain the friction member as an integral portion of the truck itself. The reservoir 76 may be independently mounted on the bottom of the board 73 and connected to the truck by a pigtail conduit 78. In FIG. 6, the activating lever 80 is shown to have the well known configuration commonly found in cable activated brakes of bicycles and motorcycles, and this type of lever is equally adaptable to other vehicles such as roller skates.

Truck 74 may be adapted to house an annular friction member as previously described, or some other shape may be employed. In FIGS. 7 and 8 the friction member 80 is a cylinder offset from the wheel axle but otherwise operated much as in the prior embodiment. An O ring seal 82 prevents loss of fluid, which is supplied by means of an internal passageway 84, FIGS. 8 or 9, extending across the truck. Because the friction member 80 is substantially smaller in relative braking surface area than annular member 18, the wheel 28 may be provided with an inset contact ring 86 of a harder material than the resilient wheel to receive the friction of the member 80 while preventing erosion of the inside wheel wall.

In FIG. 9, a further modification of the braking system removes the hydraulic fluid reservoir from direct contact with the skate board and places it in the activating lever 80, for example in a reservoir and piston assembly 88, FIG. 6, connected to the truck 74 by a fluid line 90. This embodiment is also adaptable to the annular friction pad of FIGS. 1–4.

Although the hydraulically activated brake is preferred for its inherent pressure equalizing feature between wheels and, if desired, between trucks connected to a single master cylinder, a mechanical equivalent could be created with a scissors action activating mechanism. In addition, the friction member may assume still other configurations and may include the movement of drums 14 and 16 with respect to reservoir housing 12, or assist unit 68 may be drawn axially against the wheel, reversing the functions of the assist unit and friction member as previously described. The above description will therefore be understood to be by way of example and not limitation.

I claim:

1. A brake assembly for vehicles having a resilient wheel, comprising: a housing carried by the vehicle; a friction member connected to said housing and adapted to be positioned opposite a first side wall of the wheel for displacement against the wheel side wall; brake assisting means more rigid than the wheel and carried by the vehicle opposite a second side wall of the wheel for limiting the available lateral deformation of the wheel under lateral pressure from the friction member; and means for selectively activating the friction member to be displaced from the housing.

2. The brake assembly of claim 1, wherein said housing comprises a fluid reservoir connected to a friction member-carrying drum, and said activating means comprises a piston movable in the reservoir to force fluid from the reservoir into said drum to move the friction member with respect to the drum.

3. The brake assembly of claim 2, wherein said activating means further comprises a hand engageable lever connected to said piston for selectively moving the piston in the reservoir.

4. The brake assembly of claim 3, wherein said activating means further comprises a cable and sheath assembly connected between said hand engageable lever and said housing, wherein a first end of the cable is attached to the lever for movement of the cable with respect to the sheath in response to lever movement, and the second end of the cable is connected to the piston for movement of the cable and piston with respect to the sheath and housing.

5. The brake assembly of claim 3, wherein said activating means further comprises a flexible conduit connecting the fluid reservoir to the friction member-carrying drum for transmitting fluid to the drum in response to lever movement.

6. The brake assembly of claim 2, further comprising conduit means for carrying fluid from said fluid reservoir to said drum.

7. The brake assembly of claim 6, wherein said reservoir and drum are rigidly held together by fastening means and said conduit means comprise aligned bores connecting the drum and reservoir.

8. The brake assembly of claim 6, wherein said reservoir and drum are individually carried by the vehicle, and said conduit means comprises a tube interconnecting the reservoir and drum.

9. The brake assembly of claim 8, wherein said drum comprises an axle-carrying truck for a wheel.

10. The brake of claim 6, wherein the conduit means comprises a flexible tube connecting said housing and said drum, and wherein the drum comprises an axle carrying truck for a wheel.

11. The brake assembly of claim 1, wherein said housing comprises a drum having a recess for receiving said friction member and permitting movement of the friction member against a wheel side wall.

12. The brake assembly of claim 11, wherein said friction member is annular and is adapted to be received over the wheel axle of the vehicle.

13. The brake assembly of claim 11, wherein said friction member is cylindrical and said drum is adapted to carry the friction member offset from the wheel axis.

14. The brake assembly of claim 11, wherein said drum comprises a bore for receiving a wheel axle therethrough; and means for maintaining said drum in a fixed rotational position with respect to an axle through the bore.

15. The brake assembly of claim 14, wherein said means for maintaining the drum in a fixed rotational position comprises a keyway in the drum aligned with the side of said bore.

16. The brake assembly of claim 1, wherein said brake assisting means further comprises joining means for nonrotational attachment to a wheel axle during braking.

17. The brake assembly of claim 1, wherein said brake assisting means comprises a disc having a central stem adapted to engage a wheel axle.

18. The brake assembly of claim 1, further comprising a wear resistant ring connectable to the wheel side wall facing said friction member.

* * * * *